US006837539B1

(12) United States Patent
Casey

(10) Patent No.: US 6,837,539 B1
(45) Date of Patent: Jan. 4, 2005

(54) MOVABLE TABLET ASSEMBLY AND SEAT

(75) Inventor: David Casey, Senatobia, MS (US)

(73) Assignee: Chromcraft Corp., Senatobia, MS (US)

( * ) Notice: Subject to any disclaimer, the term of this patent is extended or adjusted under 35 U.S.C. 154(b) by 0 days.

(21) Appl. No.: 10/743,233

(22) Filed: Dec. 22, 2003

(51) Int. Cl.[7] ..... A47B 39/00
(52) U.S. Cl. ..... 297/162; 297/448.2; 297/294
(58) Field of Search ..... 297/451.7, 294–295, 297/448.2, 160–162, 135, 174 R, 170, 316, 340, 300.2, 325, 302.1, 297, 324

(56) References Cited

U.S. PATENT DOCUMENTS

| | | | | |
|---|---|---|---|---|
| 3,102,754 A | | 9/1963 | Junkunc | |
| 3,140,894 A | | 7/1964 | Hicke | |
| 3,194,600 A | | 7/1965 | Junkunc | |
| 3,197,253 A | | 7/1965 | Brown | |
| 3,197,254 A | | 7/1965 | Hendrickson | |
| 3,269,772 A | | 8/1966 | Brunskole | |
| 3,353,866 A | | 11/1967 | Chapman et al. | |
| 3,367,713 A | | 2/1968 | Krueger | |
| 3,547,488 A | | 12/1970 | Barnes | |
| 3,556,588 A | | 1/1971 | Monyer et al. | |
| 3,567,277 A | | 3/1971 | Van Ryn | |
| 3,675,968 A | | 7/1972 | Douglas | |
| 3,784,249 A | | 1/1974 | Hendrickson et al. | |
| 4,159,846 A | | 7/1979 | Tolleson | |
| 4,216,994 A | | 8/1980 | Benoit | |
| 5,451,092 A | * | 9/1995 | Gray | 297/122 |
| 5,683,136 A | | 11/1997 | Baumann et al. | |
| 5,765,911 A | * | 6/1998 | Sorenson | 297/173 |
| 5,823,626 A | | 10/1998 | Haas | |
| 5,845,964 A | | 12/1998 | Phoon | |
| 6,073,997 A | | 6/2000 | Koh | |
| 6,604,784 B1 | * | 8/2003 | Bosman et al. | 297/171 |
| 6,634,717 B2 | * | 10/2003 | Kown | 297/446.2 |

* cited by examiner

*Primary Examiner*—Milton Nelson, Jr.
(74) *Attorney, Agent, or Firm*—Wolf, Greenfield & Sacks, P.C.

(57) ABSTRACT

A chair and tablet combination has a tablet movable from a generally horizontal, operative position above the seat and in front of the backrest to a vertical stored position beside the chair. The chair may have upright and reclined positions for the occupant, and the tablet remains stationary when the chair moves from one position to another.

4 Claims, 7 Drawing Sheets

MOVABLE TABLET ASSEMBLY AND SEAT

FIELD OF INVENTION

This invention relates to seating having tablets that are movable between stored and operable positions.

BACKGROUND AND SUMMARY OF THE INVENTION

Chairs with retractable tablets that move between operative and stored positions are well-known in the art. Examples of the prior art are shown in the following prior patents:

| | |
|---|---|
| 3,102,754 | 3,556,588 |
| 3,140,894 | 3,567,277 |
| 3,194,600 | 3,675,968 |
| 3,197,253 | 3,784,249 |
| 3,197,254 | 4,159,846 |
| 3,269,772 | 4,216,994 |
| 3,367,713 | 5,683,136 |
| 3,547,488 | 5,845,964 |
| | 6,073,997 |

The present invention employs a relatively inexpensive and uncomplicated mechanical arrangement for providing movement for the tablet and is suitable for use in a variety of seating including motion chairs.

In accordance with one aspect of the present invention, the assembly for mounting the tablet is suitable for use in motion furniture that will support the tablet in an operative position whether the chair and particularly the backrest is in an upright or inclined position. Another aspect of the present invention is a chair and tablet combination wherein the chair has a movable seat and/or backrest and in which the tablet remains fixed or is non-responsive to changes in the positions of the seat and/or backrest. Yet another aspect of the invention is that the tablet may easily be moved between stored and operative positions by a person either seated in the chair or standing beside it.

In accordance with one form of the invention the tablet is movable between a stored position substantially in a vertical plane along the side of the chair and an operable position in a substantially horizontal plane above the chair seat and in front of the backrest so as to provide a convenient and comfortable working surface for the chair occupant. In accordance with another form of the invention, the tablet is mounted on a fixed portion of the chair frame so that the tablet position is independent of and uneffected by any change in position of the seat and/or backrest of the chair. In accordance with yet another form of the invention, the mechanism for supporting the tablet includes a base plate mountable on a fixed portion of the chair frame or an extension thereof and a hinge plate disposed in a plane parallel to and closely adjacent the base plate. The two plates are secured together by a shaft that enables the hinge plate to pivot in a plane parallel to the base plate, and the hinge plate carries a hinge connected to and which supports the tablet. The mechanism enables the tablet to move from a stored position in a substantially vertical plane, through a second position in the same vertical plane but displaced approximately 90° about the axis of the shaft, and finally to an operative position wherein the tablet is turned about the hinge to a substantially horizontal plane in front of the backrest and above the seat.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
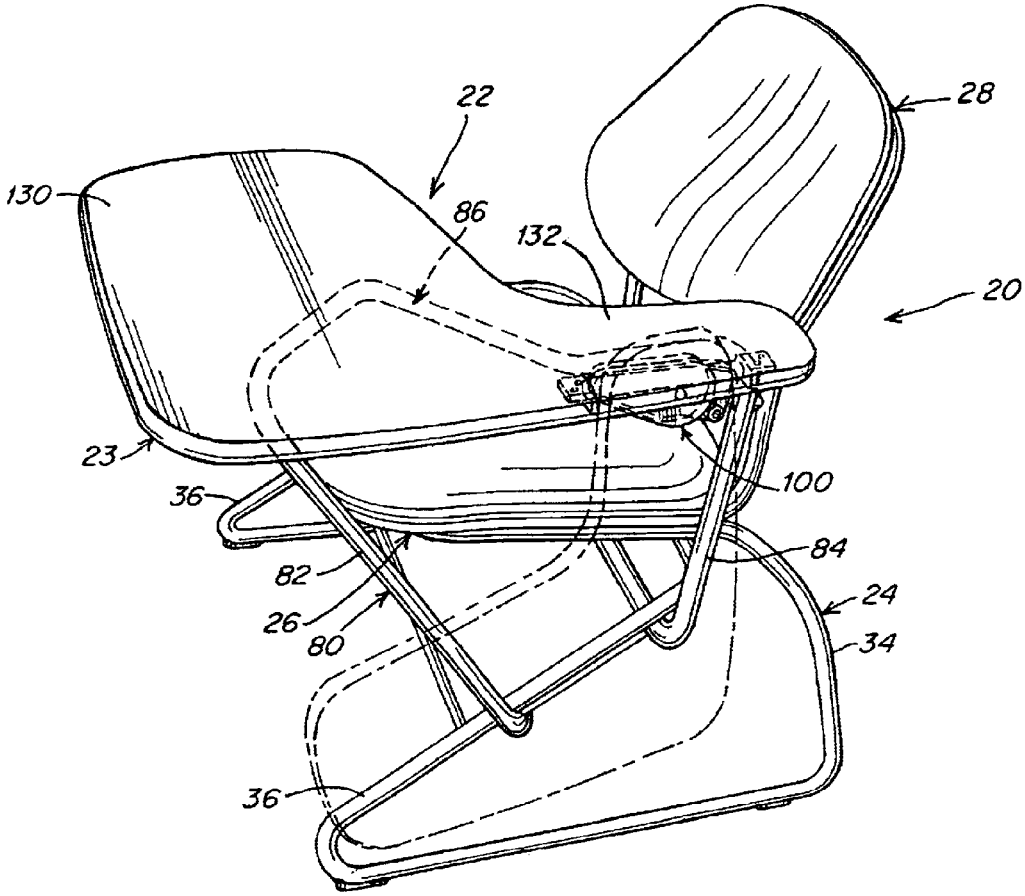
FIG. 1 is a top front perspective view of a chair with tablet constructed in accordance with this invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

Figure 2:
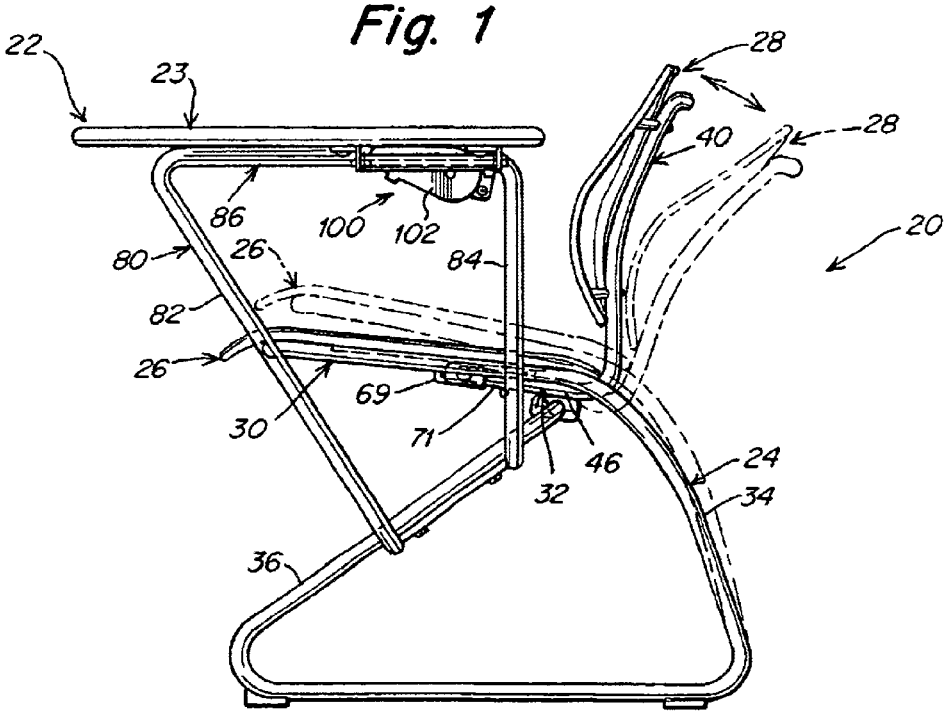
FIG. 2 is a right side elevation view thereof.

The chair/tablet combination in the embodiments illustrated includes a chair 20 and tablet assembly 22. It should be appreciated, however, that the invention is not limited to a chair/tablet combination embodying the chair like that illustrated. Rather, the invention has much wider application. The chair 20 shown includes a frame 24, seat 26 and backrest 28, and the seat and backrest are movable between upright and somewhat inclined positions as shown in FIG. 2 in full and broken lines respectively. In the embodiment shown, the frame 24 includes a first seat frame 30 and a second seat frame 32 (see FIGS. 3 and 7) disposed in adjacent positions below the seat and respectively supported by the rear legs 34 and front legs 36 of the chair frame 24. The seat frames 30 and 32 support the seat 26 in cantilevered fashion. The first seat frame 30 and the rear legs 34 are integrally formed preferably of steel tubing. The seat is tiltable with respect to the rear legs 34 of the frame as the junctures 38 of the rear legs 34 and first seat frame 30 act as torsion springs.

The chair back 28 is carried on the back frame 40 that, in turn, is connected to the top bar 42 which joins the top ends of the frame front legs 36. The back frame 40 includes an inverted U-shaped portion 44 that extends upwardly from the rear of forwardly extending generally horizontal arms 46 that comprise the second seat frame 32. The arms 46 are attached to top bar 42 by brackets 48. The arms 46 are also joined by a rigid cross bar 50 disposed below and spaced from the seat 26. The brackets 48 are permitted limited pivotal motion on the top bar 42 to enable the backrest to pivot rearwardly approximately 20° to an inclined position when the chair occupant pushes back against the backrest, as shown in full lines in FIG. 6.

The seat 26 typically contour molded of a plastic material such as polypropylene (as is the backrest 28) carries on its bottom surface a pair of steel plates 60 extending front to back along each side thereof. The plates 60 in turn carry on their bottom surfaces brackets 62 that are disposed somewhat rearwardly of the transverse centerline of the seat. The outside edges 66 of the plates 60 are welded or otherwise fixed to the side bars 68 of the first seat frame member 30. The brackets 62 in turn are pivotally mounted on axles 64 attached to the front ends of the arms 46 of the second seat frame by brackets 69 and provide limited pivotal motion of the seat 26 on the axles.

When rearwardly directed force is exerted against the backrest 28, the backrest frame 40 pivots rearwardly with the brackets 48 on the top bar 42 causing the front ends 71 of the arms 46 of the backrest frame to elevate, which in turn causes the axles 64 and the brackets 69 pivotally connected to them, to rise. That action exerts an upward push on the bars 68 of the first seat frame 30. The flexibility of the base frame at the junctures 38 of the fear legs 34 and the seat frame enables the seat to elevate, particularly at the front portion, so as to achieve a comfortable angle with respect to the reclined backrest 28. When the rearwardly directed force against the backrest 28 is relieved, the backrest returns to the biased position established by the configuration of the back frame 40 and backrest 28, and the seat 26 returns to its normal position with respect to the seat frames.

Figure 3:
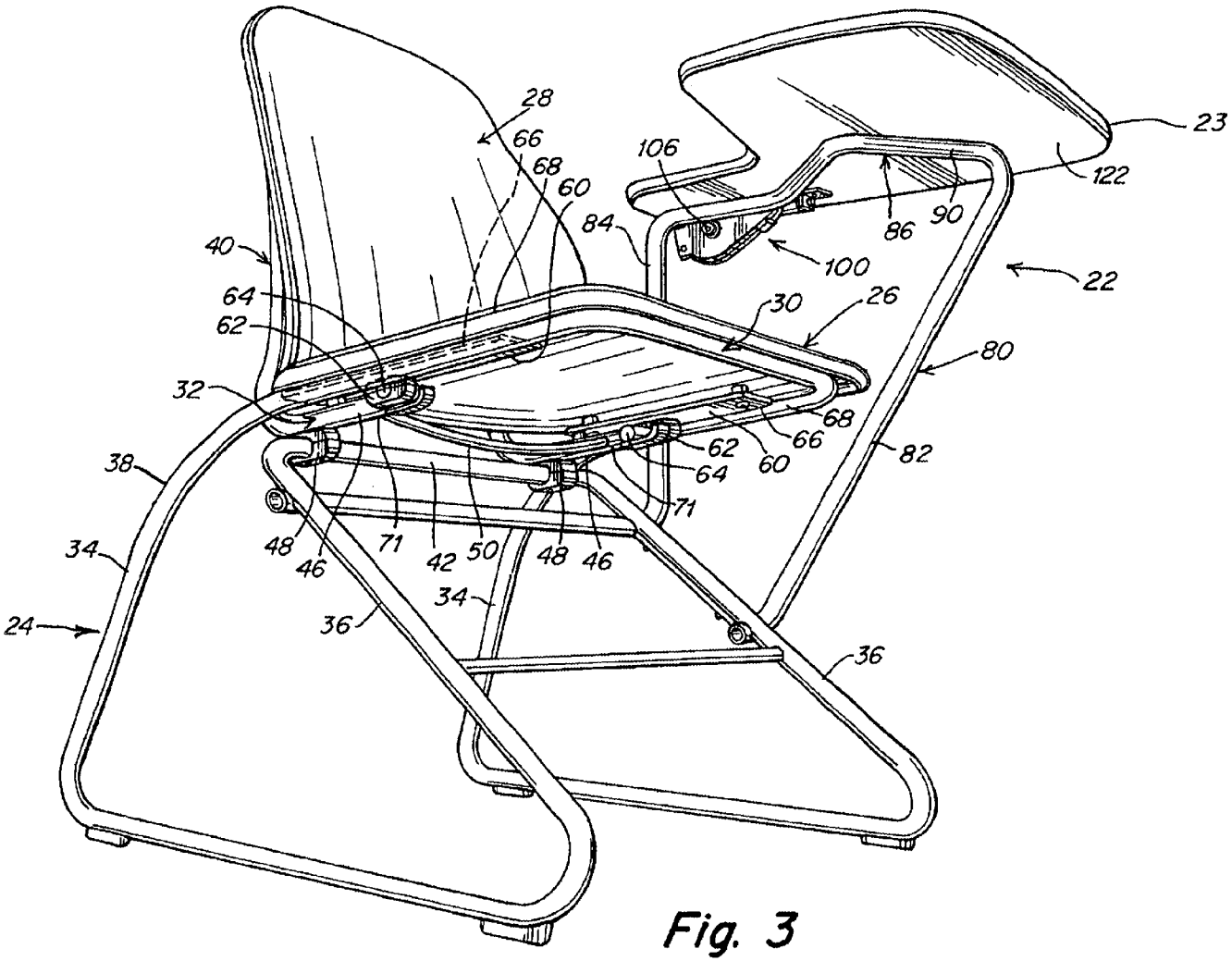
FIG. 3 is a bottom front perspective view of the chair with tablet shown in FIGS. 1 and 2.

In accordance with another aspect of the present invention, the tablet assembly 22 includes an auxiliary frame 80 connected to the front legs 36 of the chair frame 24. In the embodiment shown, the tablet assembly is mounted on the left side of the chair particularly suited for a left handed person, but it is to be understood that a mirror image of the assembly shown may be mounted on the right side of the chair. The auxiliary frame 80 has a pair of downwardly converging front and rear legs 82 and 84 and a generally horizontal section 86. Both legs 82 and 84 are connected to the front leg 36 of the chair frame on the same side of the tablet, and leg 82 also extends across the chair frame 24 beneath the seat and attaches to the other front leg as well. In the embodiment shown, the rear leg 84 is essentially vertical but it is to be understood that it is not an essential characteristic of the frame 80. Section 86 of the frame 80 includes a horizontal portion 90 that supports the tablet 23 when in its operative position as shown in FIG. 3. Section 86 also carries the mechanism 100 of the tablet assembly 22 that enables the tablet 23 to move between the operative and stored positions. The frame may, of course, have other configurations but it should be connected to a relatively stationary portion of the chair frame so as not to impart motion to the tablet when the position of the seat and/or backrest is changed.

Figure 11:
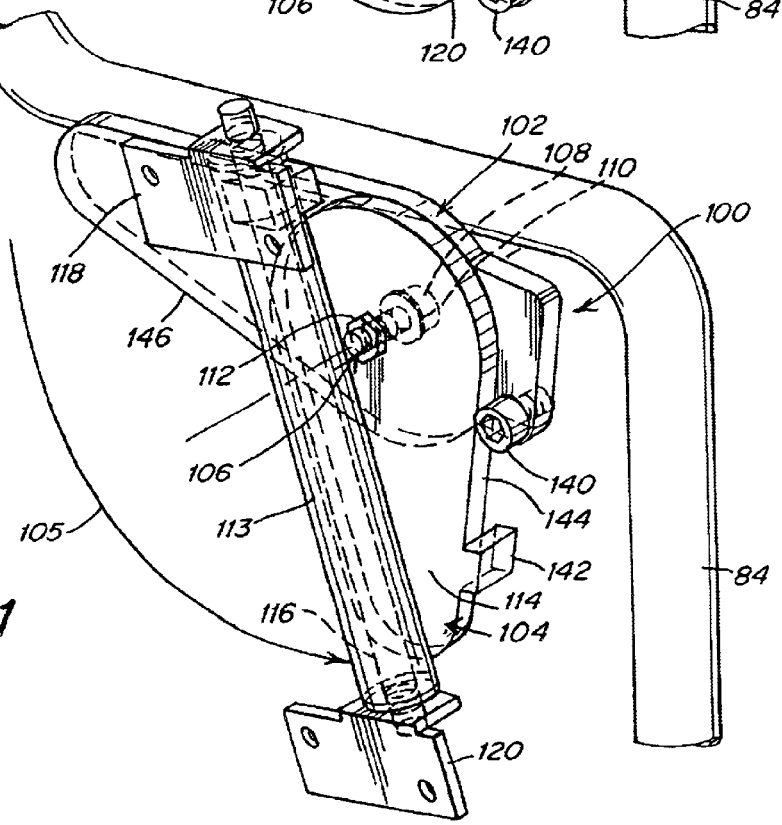

In accordance with another aspect of the present invention, the mechanism 100 includes a base plate 102 that is welded or otherwise secured to the upper section 86 of the auxiliary frame 80, adjacent the rear leg 84. The base plate 102 oriented in a substantially vertical plane carries a hinge plate 104 by means of a swivel 106 that in the embodiment shown, includes a shoulder screw 108, belleville and spring washers 110, and locknut 112. The swivel 106 enables the hinge plate 104 to rotate in a vertical plane immediately adjacent the plane of the base plate 102 as suggested in FIG. 11 by arrow 105.

Figure 6:
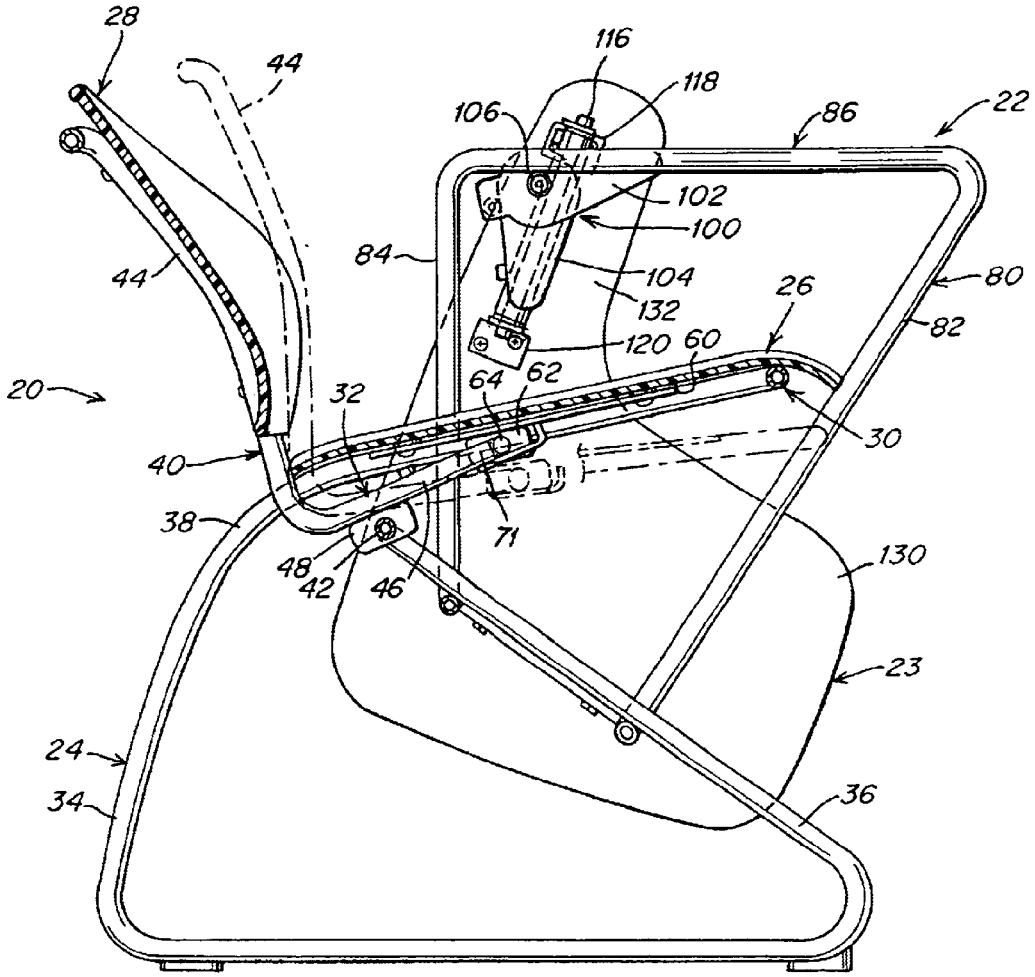
FIG. 6 is a somewhat schematic cross-sectional view similar to FIG. 5 but with the seatback shown in a reclined position and the tablet fully stowed.
Figure 7:
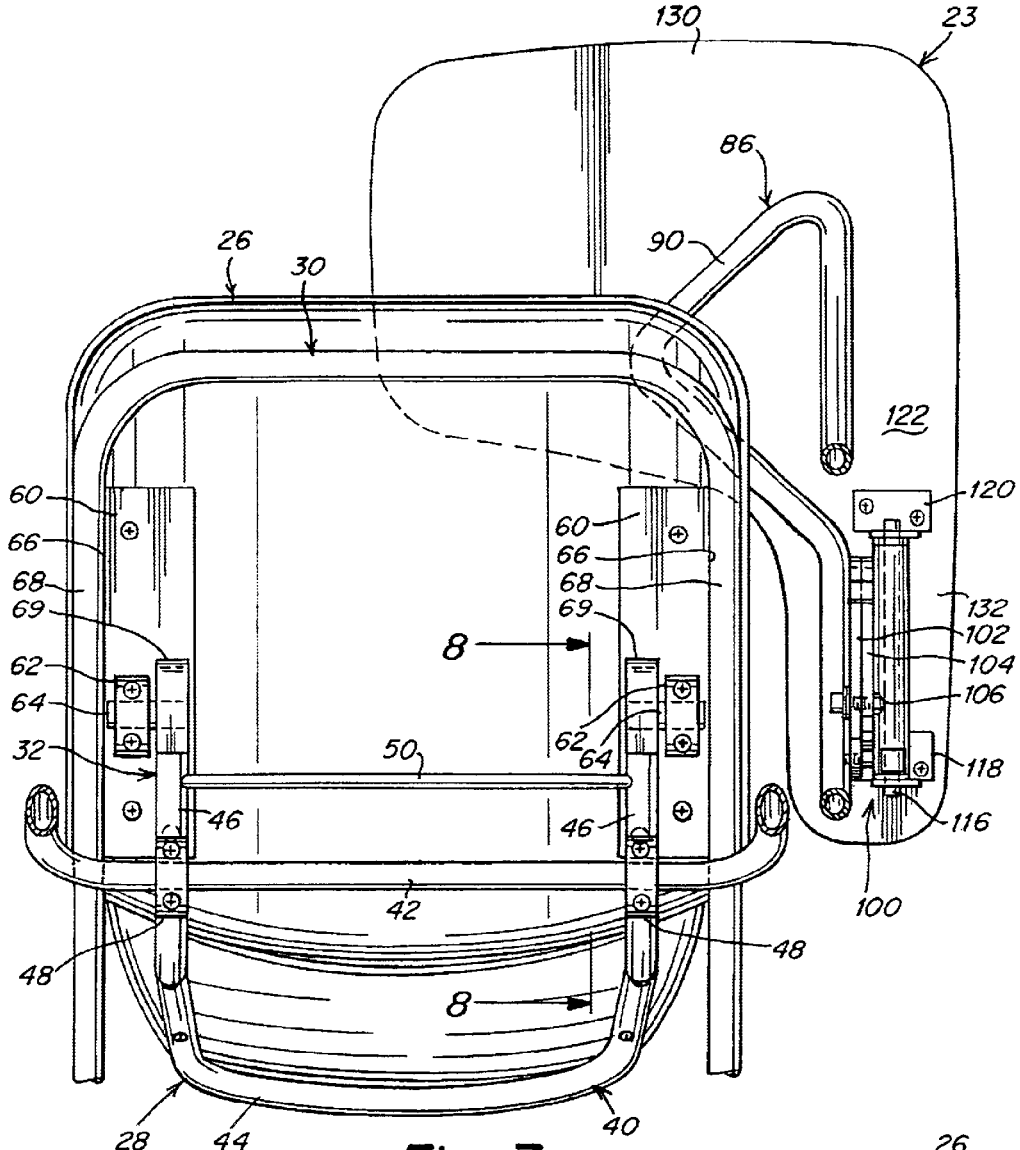
FIG. 7 is a bottom view taken along the section line 7—7 in FIG. 4.
Figure 8:
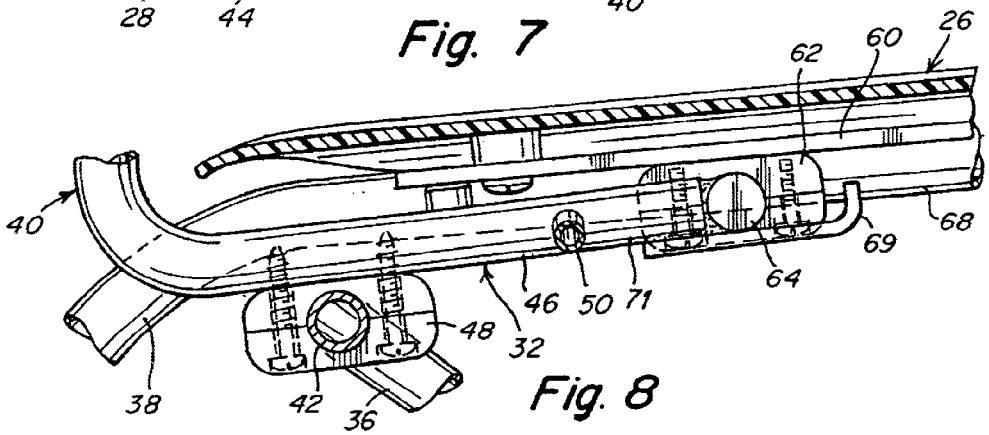
FIG. 8 is an enlarged fragmentary cross-sectional view taken along section line 8—8 of FIG. 7.

A sleeve 113 is attached as by welding or other means to the face 114 of the hinge plate 104 away from the base plate 102, and it rotatably supports a pin 116 that extends through it. The pin in turn carries a pair of brackets 118 and 120, one at each end, that are secured to the surface 122 of the tablet 23 in spaced relationship to one another by means of screws or other fasteners The tablet 23 includes a main working portion 130 and an arm extension 132 that together are generally L-shaped. The brackets 118 and 120 carried by the pin 116 are connected to the inner and outer ends of the arm extension 132 as shown in FIGS. 6 and 7.

Figure 4:
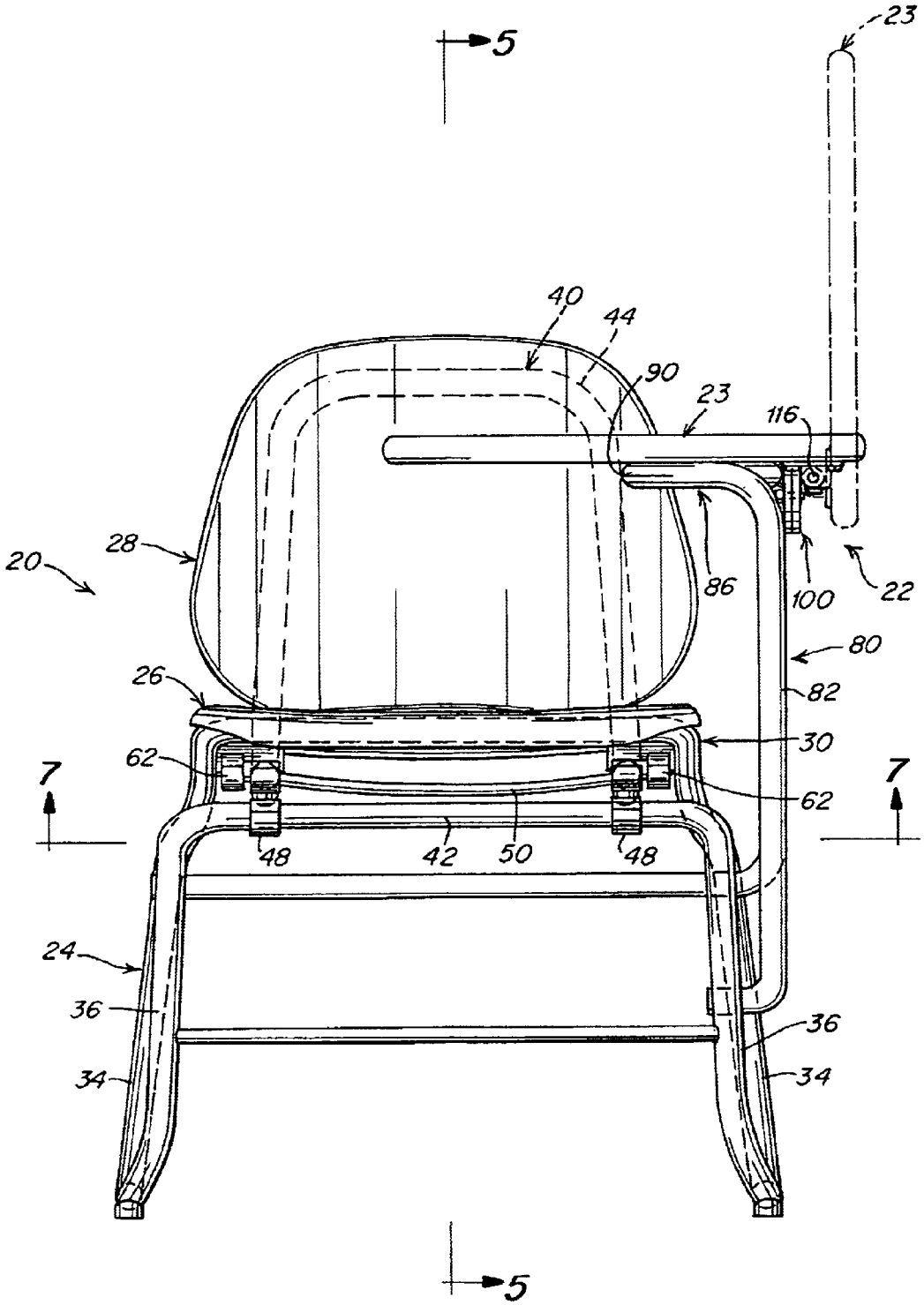
FIG. 4 is a front elevation view thereof with the tablet shown in the operative position in full lines and in an intermediate partially retracted position shown in broken lines.
Figure 5:
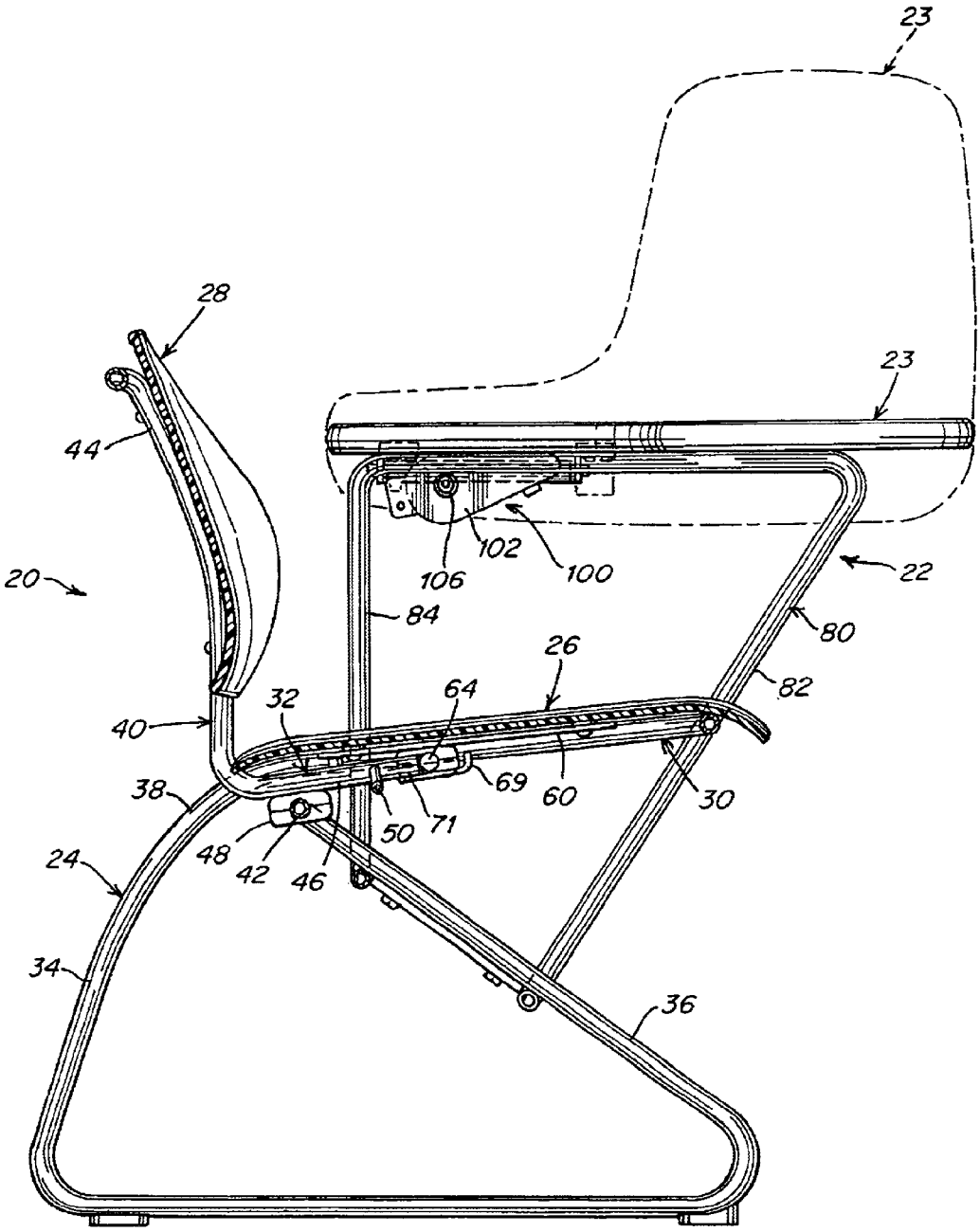
FIG. 5 is a cross-sectional side view taken along the section line 5—5 of FIG. 4.
Figure 9:
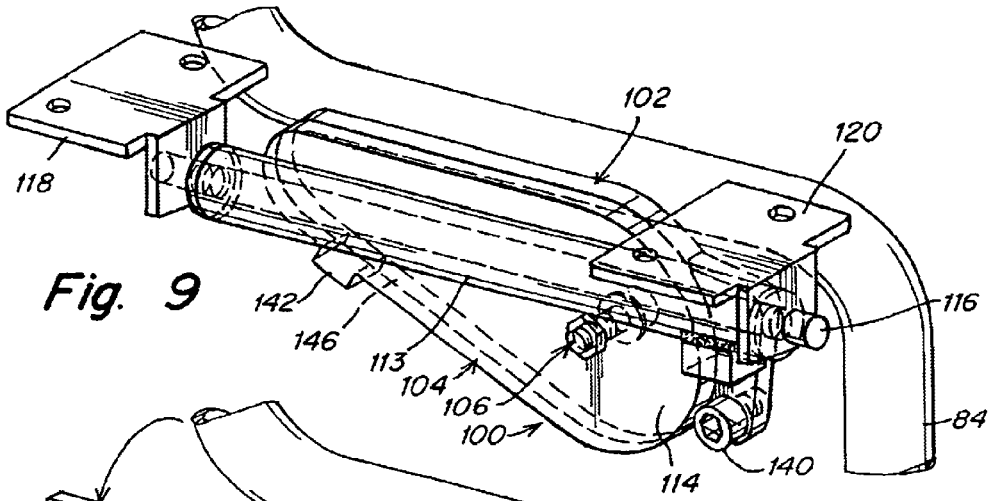
FIGS. 9, 10 and 11 are fragmentary perspective views showing the mechanism that supports the tablet when the tablet is in the operative, partially retracted and fully stowed position respectively.
Figure 10:
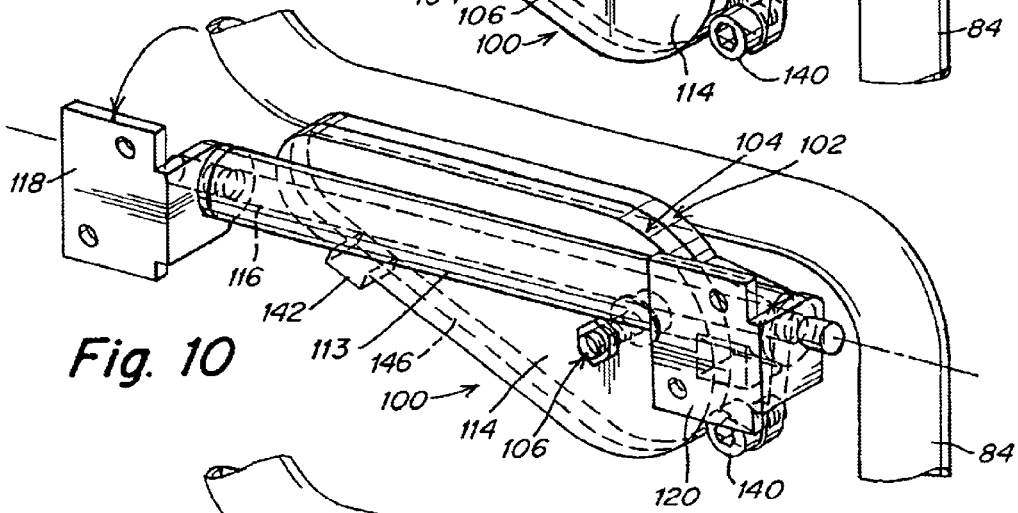

As described in greater detail below, the swivel 106 rotates about a substantially horizontal axis and in so doing, enables the tablet 23 to pivot in a substantially vertical plane between the positions shown in full lines in FIG. 6 and broken lines in FIG. 5, that is between the stored and intermediate positions. The hinge 100 in turn enables the tablet 23 to pivot between the intermediate position shown in broken lines and the operative position shown in full lines in FIG. 4. In the operative position, the tablet rests on the horizontal portion of section 86 of auxiliary frame 80 and above the seat and in front of the backrest in position for use by an occupant of the chair. To achieve the operative position the tablet moves through the position shown in broken lines in FIG. 5. In the stored or inoperative position of FIG. 6, the tablet 23 is disposed in a vertical plane with the arm extension 132 disposed above the main working surface 130 of the tablet. This position is attained by first pivoting the tablet 23 by means of hinge 100 from the operative or horizontal position shown in full lines in FIG. 4 on the pin 116 about the axis of the sleeve 113 to the vertical plane as shown in broken lines in FIG. 4 and then turning the hinge plate 114 approximately 90° with respect to the base plate 102 about the axis of swivel 106. In the stored position, the tablet is out of the way and does not interfere with use of the chair as a seat. Moreover, the chair may be moved between the upright and inclined positions without any significant effect on the position of the tablet. When the tablet 23 is to be moved to its operative position of FIG. 14 from the stored position of FIG. 6, the tablet is first rotated in a vertical plane about the axis of the swivel 106 with the hinge plate 104. That action moves the hinge plate 104 and sleeve 113 and pin 116 from the orientation shown in FIG. 11 to the position of FIG. 10. Once rotated in that manner through approximately 90°, the tablet 23 may be rotated on the pin 116 about the substantially horizontal axis of the sleeve 113 to place it in front of the backrest and above the seat in a working or operative position as the mechanism 100 is oriented as shown in FIG. 9. The arm extension 132 of the tablet 23 in that position serves as a convenient arm rest on the side of the chair.

The rotation of the hinge plate 104 on the swivel 106 is limited to approximately 90° by a pair of stops 140 and 142 respectively carried on base plate 102 and hinge plate 104. Stop 140 is positioned on base plate 102 to engage the edge 144 of the hinge plate 104 (see FIG. 11) when the tablet 23 reaches the stored position, and stop 142 carried on the hinge plate 104 engages the lower edge 146 of base plate 102 when the axis of the sleeve is in the horizontal position and enables the tablet to pivot to the operative position. It will be appreciated that the stops 140 and 142 may take many different forms. The two plates 102 and 104 attached by the swivel 106 in face-to-face relationship prevent the tablet from swinging in a horizontal plane toward or away from the operative position.

It will be appreciated that when in the operative position the tablet remains essentially undisturbed when the backrest and/or seat are moved between the upright and reclined positions. Thus, any papers, food, drink or other material on its work surface will not slide off or otherwise be disturbed when the seat and backrest move.

It should also be appreciated that the mechanism 100 for supporting the tablet as well as the mechanism that enables the seat and/or backrest to move may be varied without departing from the spirit of the present invention. In accordance with one aspect of the invention, the reclining motion of the chair may be confined to the backrest or seat alone. For example, the backrest may be mounted to move slightly from an upright to an inclined position without modifying the orientation of the seat.

Having thus described several aspects of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A motion chair and tablet combination comprising a chair frame, a body support including a backrest and seat carried on the frame, at least one of the backrest and seat being movable between upright and reclined positions, and a tablet connected to the frame, said tablet maintaining a fixed position unchanged by movement of the backrest or seat when moved between the upright and reclined positions, wherein the tablet is a substantially planar member and is movable between a stored position disposed in a substantially vertical plane on one side of the chair and an operative position wherein it is disposed substantially in a horizontal plane above the seat of the chair, and further wherein the tablet when moved from the stored to the operative position passes through an intermediate position wherein it is displaced in said vertical plane approximately 90° from the stored position and then pivoted about a horizontal axis to the operative position into the substantially horizontal plane.

2. A motion chair and tablet combination as described in claim 1 wherein the tablet is mounted to the frame by a mechanism that includes a hinge plate pivotally connected to the frame and movable in a substantially vertical plane, a sleeve carried by and movable with the hinge plate, and a pin rotatable in the sleeve and carrying the tablet.

3. A motion chair and tablet combination as described in claim 1 wherein the tablet is mounted to the frame by a mechanism including a base plate fixed to the frame, a hinge plate pivotally connected to rotate in a plane parallel to the base plate, and a pin rotatable about an axis on the hinge plate and carrying the tablet.

4. A combination chair and tablet comprising a chair frame and a seat and backrest mounted on the frame, an auxiliary frame connected to the chair frame beneath the seat for supporting the tablet, a mechanism mounted on the auxiliary frame including a hinge and mounting bracket for connecting the tablet to the auxiliary frame enabling the tablet to move from a substantially horizontal working position above the seat and in front of the backrest and a stored, substantially vertical position along a side of the chair effectively below the level of the seat, said chair frame includes front and rear legs connected together as a unitized structure by a base, said rear legs having forward extensions providing a cantilevered support for the seat above the front legs and being flexible to enable the seat to move upwardly with the extensions to a reclined position, a backrest frame pivotally supported by the upper ends of the front legs and supporting the backrest, and a pivotal connection joining the front end of the backrest frame to the forward extensions of the rear legs for causing the seat to tilt upwardly when the backrest frame is deflected backward to a reclining position.

* * * * *